United States Patent [19]

Rasberry

[11] Patent Number: 5,067,714

[45] Date of Patent: Nov. 26, 1991

[54] VARIABLE ARRANGEMENT FLORAL DESIGN JIGSAW PUZZLE

[76] Inventor: Leslie Rasberry, 209 Croft St., Greenville, S.C. 29609

[21] Appl. No.: 609,802

[22] Filed: Nov. 1, 1990

Related U.S. Application Data

[63] Continuation-in-part of Ser. No. 370,816, Jun. 23, 1989, abandoned.

[51] Int. Cl.[5] ..... A63F 9/10

[52] U.S. Cl. ..... 273/157 R

[58] Field of Search ..... 273/157 R; 52/311, 593, 52/594; 446/124, 125

[56] References Cited

U.S. PATENT DOCUMENTS 1,268,391 6/1918 Schepmoes ..... 273/157 R 3,334,798 8/1967 Pezely ..... 273/157 R 3,701,214 10/1972 Sakamoto ..... 273/157 R 3,755,923 9/1973 Krahn ..... 273/157 R

FOREIGN PATENT DOCUMENTS 1039473 5/1953 France ..... 273/157 R

*Primary Examiner*—Edward M. Coven

*Assistant Examiner*—Raleigh W. Chiu

*Attorney, Agent, or Firm*—Cort Flint

[57] ABSTRACT

A jigsaw puzzle is illustrated as being assembled into a plurality of arrangements, having a plurality of differently shaped and sized inner and outer pieces. The inner pieces have a plurality of sides configured to have protrusions and recesses therealong, being such that a plurality of sides of each inner piece are fittingly engageable with a plurality of sides of every other inner piece.

16 Claims, 4 Drawing Sheets

Fig. 2A
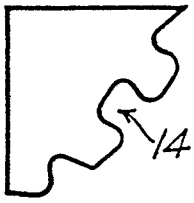
Fig. 2E
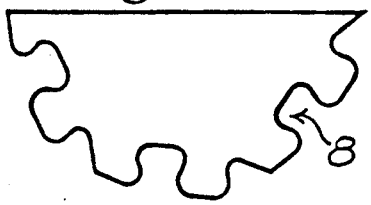
Fig. 2F
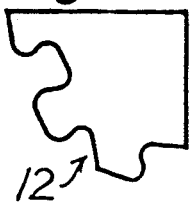
Fig. 2B
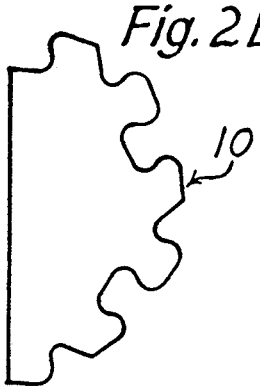
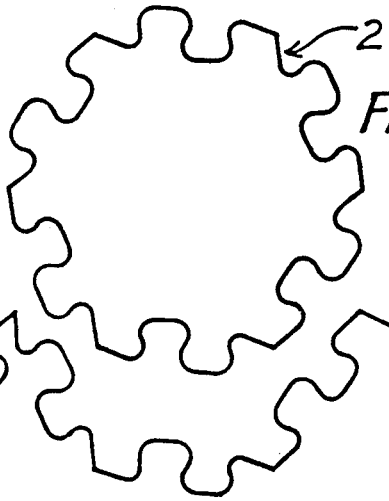
Fig. 2G
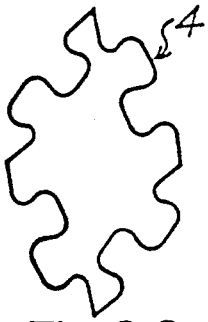
Fig. 2C
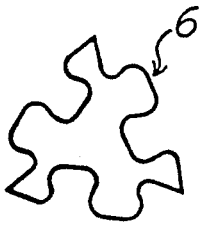
Fig. 2D
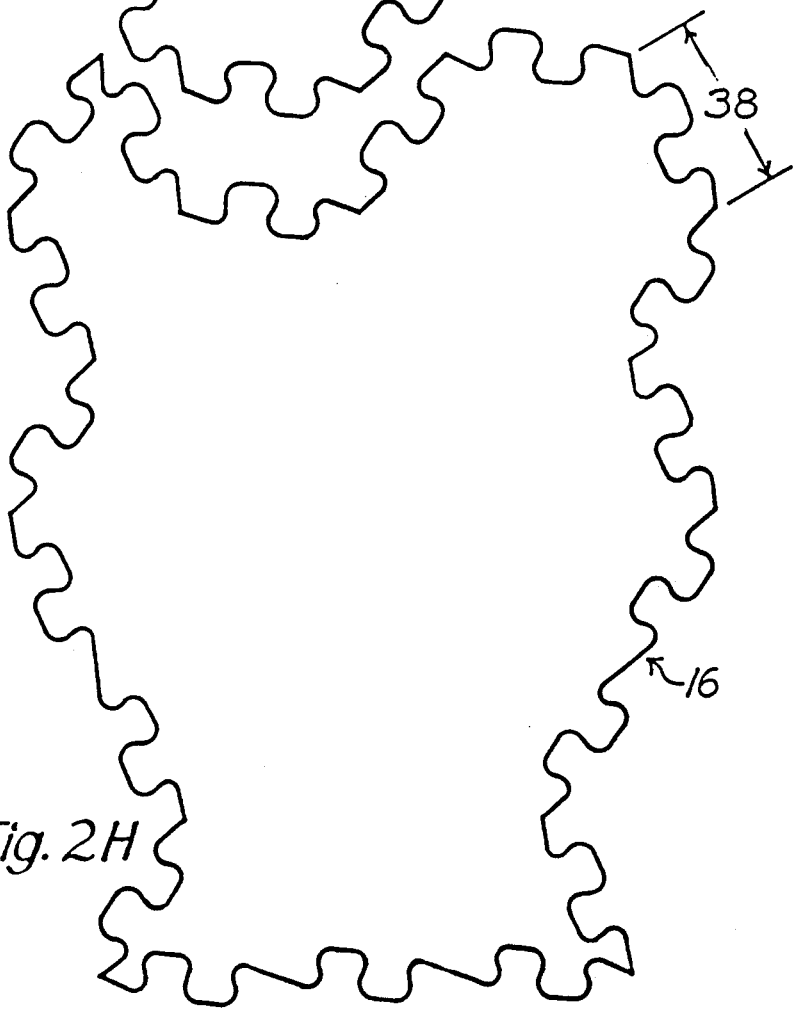
Fig. 2H

VARIABLE ARRANGEMENT FLORAL DESIGN JIGSAW PUZZLE

This is a continuation-in-part of copending application(s) Ser. No. 07,370,816 filed on Jun. 23, 1989 now abandoned.

BACKGROUND OF THE INVENTION

The invention relates to a jigsaw puzzle in which any piece is fittingly engageable with a plurality of sides of any other piece.

Heretofore jigsaw puzzles consisted of a single pictorial design formed by a plurality of differently cut pieces which had only a single position in the puzzle. The object was to into its precise place.

In a related area, it is also known to have toy sets which consist of a plurality of differently shaped pieces which interlock with each other. Such type of game is shown in U.S. Pat. No. 3,701,214. The object is to fit pieces of various shapes with other pieces of various shapes to form three dimensional structures. There is no two dimensional pictorial arrangement created but a structural build up in three dimensions.

Another known game, which is similar, is a kaleidoscopic game which consists of a plurality of flat multicolored pieces. Such an arrangement is shown in U.S. Pat. No. 3,755,923. In this game, the pieces are of various shapes such as equilateral triangles, rectangles, etc. There is no interlocking of the pieces with each other. Rather, the object is to arrange one piece next to the other. The pieces have colored patterns which overlap. The pieces must be arranged so that the patterns and piece configurations register.

There have been jigsaw puzzles in which one side of a piece would interlock with one side of a plurality of pieces. This is shown in the French Patent No. 1,039,473 to Delbard. This disclosure does not teach a complete puzzle in which all pieces interlock with a plurality of sides of any one piece.

It is an object of this invention to provide a jigsaw puzzle which is not limited to a particular size or shape, but may be assembled into various sizes and configurations.

Another object is to provide a jigsaw puzzle in which various pictorial arrangements may be formed from one set of pieces.

Another object is to provide a jigsaw puzzle which mentally stimulates the user. This is achieved because it is necessary to use imagination and creativity when assembling the puzzle.

Another object of the invention is to provide a jigsaw puzzle in which there is no definite number of pieces required to form a complete and finished puzzle.

Another object of the invention is to provide a jigsaw puzzle which may be enlarged by adding pieces from an open stock. This open stock may include duplicate blossom designs or other blossom designs as well as additional greenery and background. The open stock may also include containers created from an enlarged individual piece or plurality of small standard shaped pieces.

SUMMARY OF THE INVENTION

The above objectives are accomplished according to the present invention by providing a jigsaw puzzle capable of being assembled into a plurality of arrangements including a plurality of differently shaped and sized inner and outer pieces. Each of the inner pieces has a plurality of sides configured to have protrusions and recesses which are fittingly engageable with the sides of every other inner piece. The outer pieces consist of corner pieces having two straight sides and edge pieces having one straight side. Each corner piece and edge piece has all other sides configured with recesses and protrusions capable of fitting engagement with all sides of the inner pieces. The pieces of the groups conform in shape to one of a hexagon, a rhombus and an equilateral triangle. A container piece may be provided which displays a floral support and is at least four times larger than the inner pieces. The container piece may have all sides configured with protrusions and cavities like the configured sides of the inner and outer pieces whereby the configured sides of the base piece are fittingly engageable with any side of any other inner piece.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIGS. 2A, 2B, 2C, 2D, 2E, 2F, 2G and 2H show the basic configurations of the pieces of the puzzle;

DESCRIPTION OF THE PREFERRED EMBODIMENT

The jigsaw puzzle of the instant invention consists of a limited number of shapes for the forming pieces. As can be seen in FIGS. 2A–2G, there are only seven basic shapes used to form all the pieces of the puzzle. The shaped edge of any piece has the capability to interlock with all shaped edges of all other pieces. This arrangement creates a situation where a puzzle can be completed without using all of the pieces, or additional pieces can be obtained from open stock and the puzzle can be completed to a size larger than originally purchased.

As earlier stated, an object of this is to allow for individual creativity. To this end, the puzzle can be completed to show different floral scenes of different sizes and configurations. While the description is limited to the description of floral arrangements, it is obvious that other designs are equally applicable such as firework displays or abstract designs. Another arrangement could consist of designing the puzzle pieces so that they may be assembled into a revisable game board.

Figures 3A, 3B, 3C:
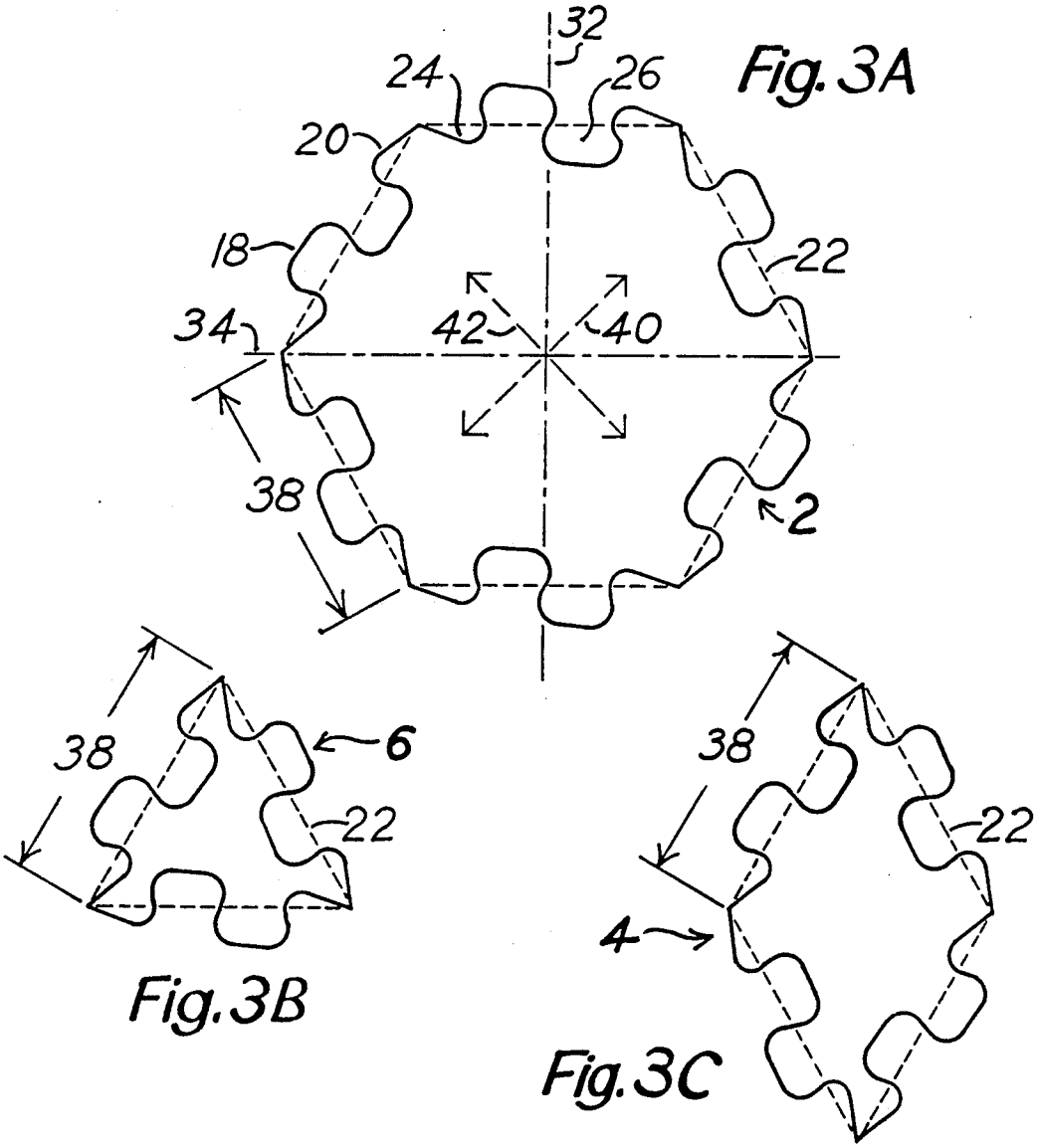
FIGS. 3A, 3B, and 3C show the geometric configurations utilized to define the puzzle pieces.

The individual pieces shown in FIGS. 2A–G are decorated to show complete scenes. The pieces 2 which are formed in a general hexagon shape, as seen in FIGS. 2G and 3A, are decorated to contain the complete pictorial image of a blossom which may be used alone or in combination with other pieces. Pieces 2 may also be colored to contain background. The pieces formed in a general rhombus shape 4, or an equilateral triangle shape 6, shown in FIGS. 2C, 3C, 2D, 3B, are decorated as greenery or as background coloring and may be used alone or in combination with other pieces. In some instances, pieces 4 may be decorated with small, but complete, blossoms. The edge pieces 8, 10 and corner pieces 12, 14, as seen in FIGS. 2A, 2B, 2E, 2F, are normally decorated with background coloring.

Each piece 2 could be labeled on its reverse side to identify the blossom shown with its common and scientific name. The number of species per set is not important because there is an open stock of pieces from which any number of species can be obtained. In this way, the user will learn to identify different flowers and also which combination of species together make the best arrangements.

Support or container piece 16, shown in FIG. 2H, may also be provided. This piece is at least four times as large as all other pieces. Its perimeter is formed with multiple side segments, each segment having the same dimension and configuration as the side segments of the smaller pieces so that all of the pieces interlock with all other pieces.

The support or container shown as single piece 16 could be formed by providing that certain pieces 2, 4, and 6 are container colored and form a container when arranged together. This alternative would allow for containers of various sizes and shapes to be configured from a limited number of pieces. No more than twenty container colored pieces, obtained from open stock, would be necessary to form the plurality of container shapes. It is noted that if it is desired to have the container formed at an edge of the puzzle, certain of pieces 8, 10, 12 and 14, could also be container colored.

It is emphasized that while a puzzle set will consist of approximately 200 pieces, it is not necessary that each piece be used to complete a puzzle. Also, because all pieces fit all other pieces, additional pieces may be acquired from open stock resulting in a completed puzzle consisting of more than 200 pieces.

Turning now to FIGS. 3A, 3B, and 3C, there are shown the general configurations from which the pieces are cut. The material used may be paper board, plastic or any other material suitable for use with the usual jigsaw puzzles. FIG. 3A shows a hexagon shape enclosed by dotted line.22. It is noted that certain portions such as at 18, 20 extend beyond the line 22, while in certain areas cavities 24, 26 protrude inside of line 22. The total area occupied by piece 2 is equal to the area within the line 22. In other words, the area which protrudes beyond the line is equal to the area cut away inside the line. FIGS. 3B and 3C show the same arrangement with triangle and rhombus shapes.

The hexagon shaped piece 2 shown in FIGS. 2G and 3A has its outer edge divided into six segments 38. The equilateral triangle shaped piece 6, shown in FIGS. 2D and 3B, has its outer edge divided into three segments 38 and the rhombus shaped piece 4, shown in FIGS. 2C and 3C, has its outer edge divided into four segments 38. Each segment 38 is configured to the same dimension and contour. This results in each segment being identical with all other segments when turned the same way and being the exact inverse of any other segment when turned the opposite way. It is preferred each segment 38 be 1¼" long, although a greater or lesser length is acceptable.

Figure 4:
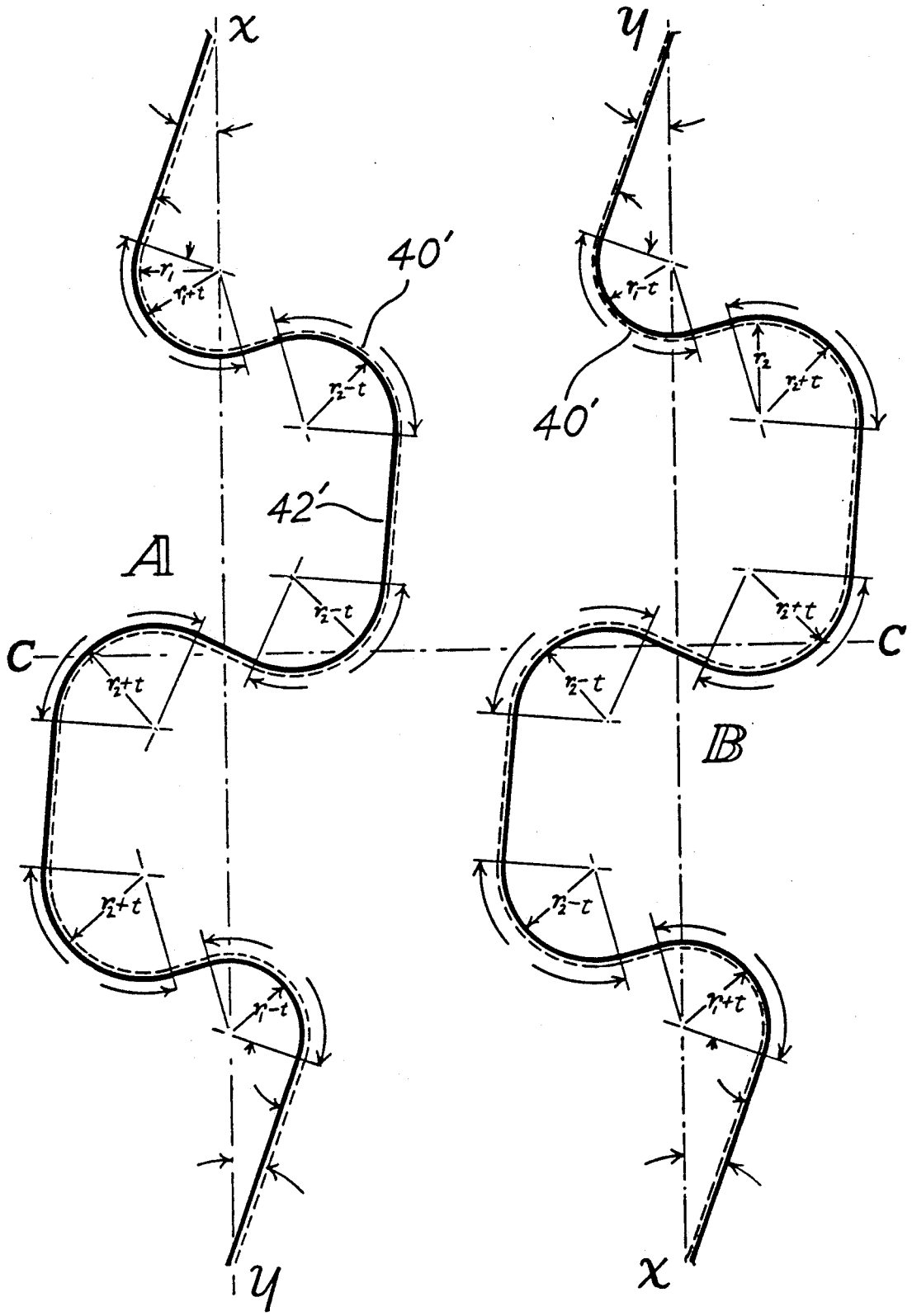
FIG. 4 shows in detail the configuration to which each side is cut.

FIG. 4 is an enlarged view of the configurations of the edge portions of all pieces. It can be seen that the pattern cut along the left edge of piece B is the exact reverse of the pattern cut along the right edge of piece A. Also, the pattern cut above line C is the exact reverse of the pattern cut below that line.

Tolerances must be made in order t the configured edges will slip easily into and out interlocking relationships. To this end, dotted line 40' represents the nominal edge of pieces A and B while solid line 42' indicates the actual edge. The space between lines 40', 42' represents the tolerance allowed. A range of 0.002" −0.005" is normal. The amount of tolerance is controlled by adjusting the length of radii r. To this end, some radii are larger and some smaller. For example, the radii forming a concave arcare indicated as $r_1+t$ or $r_2+t$, while those forming a convex arc are indicated as $r_1-t$ or $r_2-t$.

The side pieces 8 and 10, shown in FIGS. 2B, 2E, are formed by cutting hexagon piece 2 in half along either of the lines 32, 34, which run through the center of the hexagon as shown in FIG. 3A. The corner pieces 12, 14 are formed by cutting the hexagon piece into four equal pieces or quarters along lines 32, 34 shown in FIG. 3A. It is noted that the straight edges of the corner pieces must be placed in the puzzle as they appear in FIG. 3A. That is to say that the diametrically opposed pieces along line 40 are interchangeable and may be placed in either the upper or lower diametrically opposed corner. These two pieces are not interchangeable with the pieces which extend along line 42. These latter two pieces are interchangeable between opposing corners opposite the ends of line 42. Likewise, side pieces cut a line 32 are restricted to the vertical sides while those along line 34 are restricted to the horizontal sides.

In practice, the user will select a number of pieces 2 and a general arrangement therefore will then fill in between these pieces with greenery and using pieces 2, 4, and 6. Finally, using edge and corner pieces 8, 10, 12, 14, the edging will be arranged around the figure and the puzzle completed.

Figure 1:
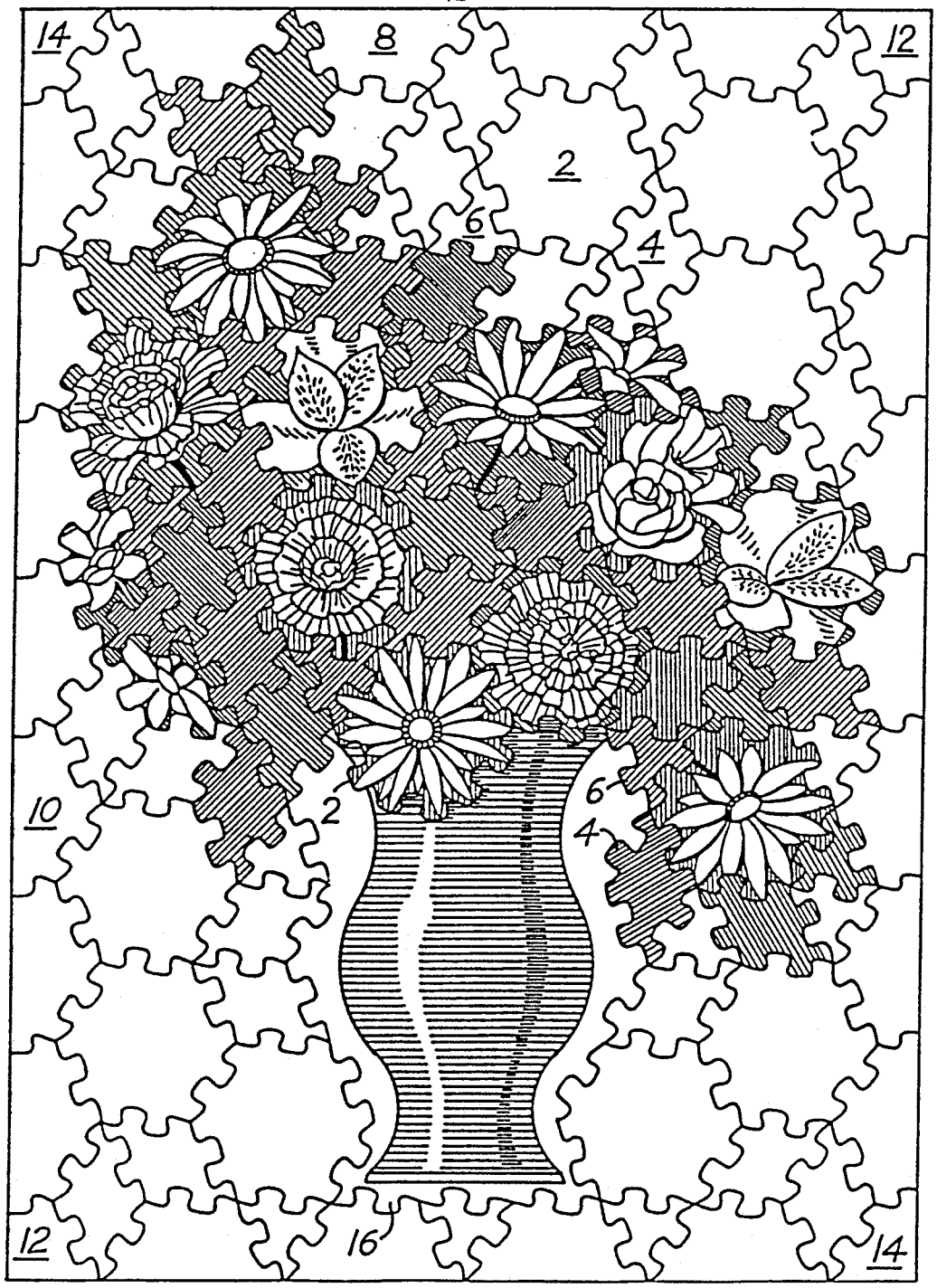
FIG. 1 is a view of a completed arrangement of the puzzle.

FIG. 1 shows one embodiment of the invention. It can be seen that each of the corner pieces and 14 are at diametrically opposed corners. Side pieces 8 form the horizontal sides and side 10 forms the vertical sides. Pieces 2, 4, and 6 are used in the background. Pieces 2 form the blossoms while pieces 6 and 4 form the greenery therearound Base 16 is shown supporting the arrangement. These same pieces could be rearranged to show a more flat arrangement in the center of the puzzle or any other arrangement that the user might conceive. The puzzle can also be arranged in a horizontal or vertical format.

While a preferred embodiment of the invention has been described using specific terms, such description is for illustrative purposes only, and it is to be understood that changes and variations may be made without departing from the spirit or scope of the following claims.

What is claimed is:

1. A jigsaw puzzle capable of being assembled into a plurlaity of arrangements, comprising:

a plurality of differently shaped and sized inner pieces and a plurality of differently shaped outer pieces; and each of said inner pieces having a plurality of sides each configured to have protrusions and recesses therealong, said configurations being such that each of said side of any inner piece is fittingly engageable with each side of every other inner piece.

2. The puzzle of claim 1 wherein said outer pieces consist of corner pieces having two straight sides and a plurality of other sides and edge pieces having one straight side and a plurality of other sides, all said other sides are configured with recesses and protrusions capable of fitting engagement with said sides of said inner pieces.

3. The jigsaw puzzle of claim 2 wherein said edge pieces and corner pieces are configured to be capable of fitting engagement with each other.

4. The jigsaw puzzle of claim 2 wherein certian of said inner pieces are shaped in the form of a hexagon;

each hexagon shaped inner piece is of equal size and each said corner piece is equal in size to one quarter section of said hexagon shaped inner piece.

5. The jigsaw puzzle of claim 2 wherien certain of said inner pieces are shaped in the form of a hexagon;

each hexagon shaped inner piece is of equal size and each said side piece is equal in size to one half section of said hexagon shaped inner piece.

6. The jigsaw puzzle of claim 1 wherein said inner pieces consist of three groups of pieces.

7. The jigsaw puzzle of claim 6 wherein said inner pieces are shaped to substantially conform with one of a hexagon, a rhombus and an equilateral triangle.

8. The jigsaw puzzle of claim 7 wherein certain of said pieces display container coloring.

9. The jigsaw puzzle of claim 7 wherein certain of the hexagon shaped members display a blossom design and certain of said hexagon shaped members display background design.

10. The jigsaw puzzle of claim 7 wherein certain of said equilateral triangle shaped members and rhombus shaped members display a greenery design.

11. The jigsaw puzzle of claim 1 wherien there is provided a container piece, said container piece being at least four times larger than the inner pieces and having at least three dges configured with protrusions and cavities whereby said configured sides of said container piece are fittingly engageable with any side of any other inner piece.

12. The jigsaw puzzle of claim 1 wherein the number of pieces necessary to complete the puzzle is variable.

13. The jigsaw puzzle of claim 1 wherein said puzzle may be enlarged by adding pieces from open stock.

14. A method of forming a jigsaw puzzle having a plurality of differently sized and shaped inner pieces each of said inner pieces having a plurality of sides, engageable with all sides of all other inner pieces said method comprising:

providing a plurlaity of specific shape categories of inner blank member; and cutting all edges of said inner blank members so that each side of every inner blank member is shaped to have the same configuration of protrusions and cavities so that each side of any inner piece is fittingly engageable with all sides of said inner other pieces.

15. The method of claim 14 wherein one category of blank member is hexagon shaped, forming corner pieces for said puzzle by dividing said hexagon shaped blank into quarters.

16. The method of claim 14 wherein one category of blank member is hexagon shaped, forming sidepieces for said puzzle by dividing said hexagon shaped blank nto halves.

* * * * *